United States Patent [19]

Broadbent

[11] 4,024,923

[45] May 24, 1977

[54] ROCK BOLTING EQUIPMENT

[76] Inventor: Kenneth Joseph Broadbent, 13 Barford St., Speers Point, New South Wales 2284, Australia

[22] Filed: Jan. 21, 1976

[21] Appl. No.: 651,146

Related U.S. Application Data

[63] Continuation-in-part of Ser. No. 307,228, Nov. 16, 1972.

[52] U.S. Cl. ..... 173/57; 173/161; 173/169; 173/170

[51] Int. Cl.[2] ..... E21C 1/10

[58] Field of Search ..... 173/36, 152, 57, 159, 173/161, 163, 169, 170; 175/209

[56] References Cited

UNITED STATES PATENTS

| | | | |
|---|---|---|---|
| 2,320,874 | 6/1943 | Lehman | 173/158 X |
| 2,804,751 | 9/1957 | Schoeder | 173/36 X |
| 3,571,874 | 3/1971 | Von Arx | 173/169 X |

*Primary Examiner*—Ernest R. Purser
*Assistant Examiner*—William F. Pate, III

[57] ABSTRACT

Equipment for drilling holes in mine roofs for the purpose of rock bolting comprises an intermediate portion having mounted on and extending from it at one end a telescopic leg and mounted on and extending from it at the other end a drill rod, a hydraulic motor mounted on the intermediate portion and coupled to the drill rod, first valve means adapted to be connected to a pressure fluid source for supplying pressure fluid to the leg for extending it or for releasing fluid from the leg, second valve means adapted to be connected to a pressure source for supplying pressure fluid to the hydraulic motor for driving it or for releasing fluid from the motor and means for controlling the first and second valve means.

9 Claims, 7 Drawing Figures

ROCK BOLTING EQUIPMENT

This is a continuation-in-part application of U.S. Ser. No. 307,228 filed Nov. 16, 1975.

The field of the invention relates to equipment for drilling holes in mine roofs for the purpose of rock bolting. Rock bolting is the process of securing in each hole, a rock bolt for the purpose of holding together the roof structure and reducing the necessity for the use of props and other timbering.

In modern times using expensive coal winning machinery it is necessary, after cool winning at the face has been carried on within safe limits, for the machinery to be withdrawn from the face so that the newly exposed roof can be rock bolted. This takes some time during which the coal winning function of the coal cutting machinery must be suspended.

From the Applicant's experience of coal winning machinery, of which the following patent references are an example of those known to the Applicant: U.S. Pat. Nos. 2,320,874, 3,275,089, 2,804,751, 1,682,438, 2,689,547, 2,461,528, 2,843,361, Canadian Pat. Nos. 853,063 and 854,046, there are a number of defects in existing machinery that render the machinery unsuitable for drilling holes in mine roofs for the purpose of rock bolting.

Under the conditions prevailing at the mine face, it is particularly desirable to provide a compact and portable roof drilling machine to enable the machine to be set up in operation with minimal delay and effort. Further as a result of the machine's compact and portable nature, special consideration must be given to operator safety and comfort from water and falling debris during the drilling operation. In existing equipment the operator either stands almost immediately beneath the hole being drilled which of course is unsatisfactory or alternatively with the more costly remote controlled equipment at a reasonably safe distance. However such conventional remote controlled equipment is not generally portable and its use can be limited in the confinements of the mine face.

It is a principal object of the present invention to provide a portable roof drilling machine which would enable the abovementioned lost time for the coal winning machinery to be safely cut to a minimum.

A further object of the invention is to take use of the means on the coal cutting machinery providing high pressure hydraulic oil for feeding winning equipment. The use of hydraulic motors instead of pneumatic motors makes it unnecessary to pipe compressed air long distances.

A further object is to provide a single portable unit means for dry drilling holes, means for wet drilling holes when required and means for maintaining the required drilling pressure against the base of the hole.

The invention therefore includes a drill motor having an extendible leg coaxially extending therefrom and a relatively long foldable arm connected at one end thereof to the drill unit, the arm having at its other end the required actuator elements for controlling the functions of the drill unit. The drill in its folded and compacted state can readily be moved by an operator who, during use of the drill, is able to control the drill at a safe distance from the drill.

Accordingly one general form of the invention is drilling equipment for drilling holes in mine roofs for the purpose of rock bolting, said equipment comprising an intermediate portion, an extendible leg mounted on and extending from one end of said intermediate portion, drill rod holding means mounted on and extending from another end of said intermediate portion, said another end of said intermediate portion being remote from said one end thereof, a rotary hydraulic motor mounted on said intermediate portion and coupled to said drill rod holding means, a longitudinal axis of said leg being substantially coaxial with the axis of rotation of said drill rod holding means, valve means for supplying pressure fluid to said motor and said leg, said valve means being mounted on said intermediate portion, an elongated torque and control arm pivotally connected to one end thereof to said intermediate portion for pivotal movement in the plane of the axis of rotation of said drill rod holding means, manual actuator means at another end of said torque and control arm remote from said one end thereof, and transmission means coupled between said actuator means and said valve means, thereby allowing an operator to control said drilling equipment from a distance.

One preferred form of the invention is shown in the accompanying drawings in which.

Figure 1:
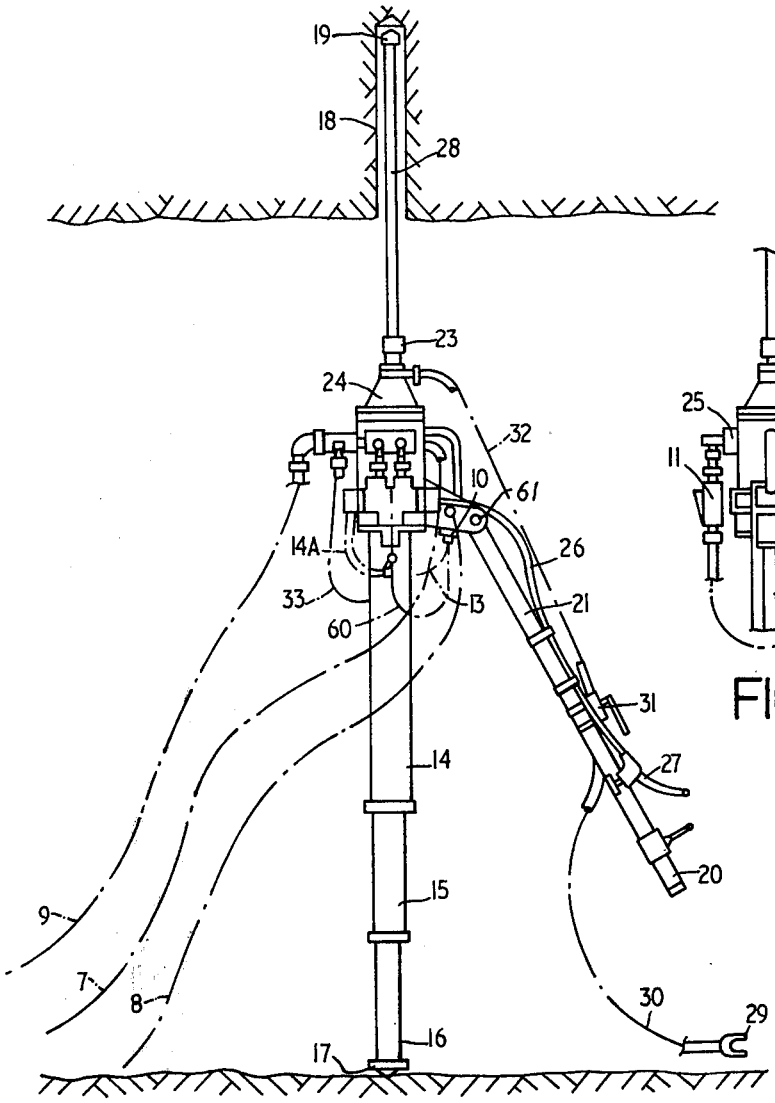
FIG. 1 is a general view showing components of the unit.
Figure 1A:
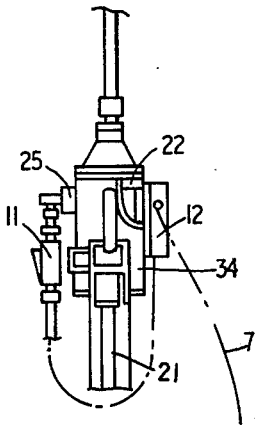
FIG. 1A is a detail view near the intermediate portion.

We refer first to FIGS. 1 and 1A. In use, the equipment is erected in the upright position as shown in FIG. 1. Individual components are shown by reference numerals on the drawing. The principal parts are as follows:

Hoses 7, 8 and 9 feed hydraulic oil under pressure to or from the drill components. Valves 10 and 11 are for controlling the flow of hydraulic oil to the drill components. Valve 12 is for dividing the oil supply from the hose 7 into two separate circuits, one of which is a pressure relieved set flow to the valve 10 through a hose 13 and the other, the remaining flow from the hose 7 to the valve 11 through a hose 14A.

Oil directed from the valve 10 through a hose 60 to the telescopic cylinder body 14 displaces telescopic components 15 and 16 causing the unit to extend until a pad 17 is firmly resisted by the ground and a drill rod 18 carrying a drill bit 19 engages the roof. Operation of the valve 10 is by twist grip 20 on the end of an elongated torque and control arm 21, which is connected at one end thereof about pivot 61 to the drill motor shell 34.

The drill rod 18 is coupled to a rotary hydraulic motor 22 through a chuck 23, and a spindle in a wet drilling unit 24 containing bearings. Oil directed from the valve 11 through fittings to an adaptor block 25 drives the hydraulic motor 22 and returns to the reservoir of the power source through the return line hose 9. Operation of the valve 11 is by a bowden cable 26, and a hand lever 27.

When the required hole 28 has been drilled, retraction of the unit is effected by allowing the oil in the telescopic cylinder to escape back through hose 60, valve 10 and non restricted hose 8 directly to the power source reservoir.

Rotation is stopped by diverting oil from the valve 11 directly into the power source return line 9, thereby bypassing the hydraulic motor 22.

Water, if necessary for dust suppression and swarf removal, is supplied to a hose clip 29 and directed through a hose 30, an ON/OFF water cock 31 and a hose 32 to the end of the drill rod 18 within the wet drilling unit 24.

Oil from the pressure relief valve within the valve 12 is drained through a hose 33 into the power source return line 9.

Figure 2:
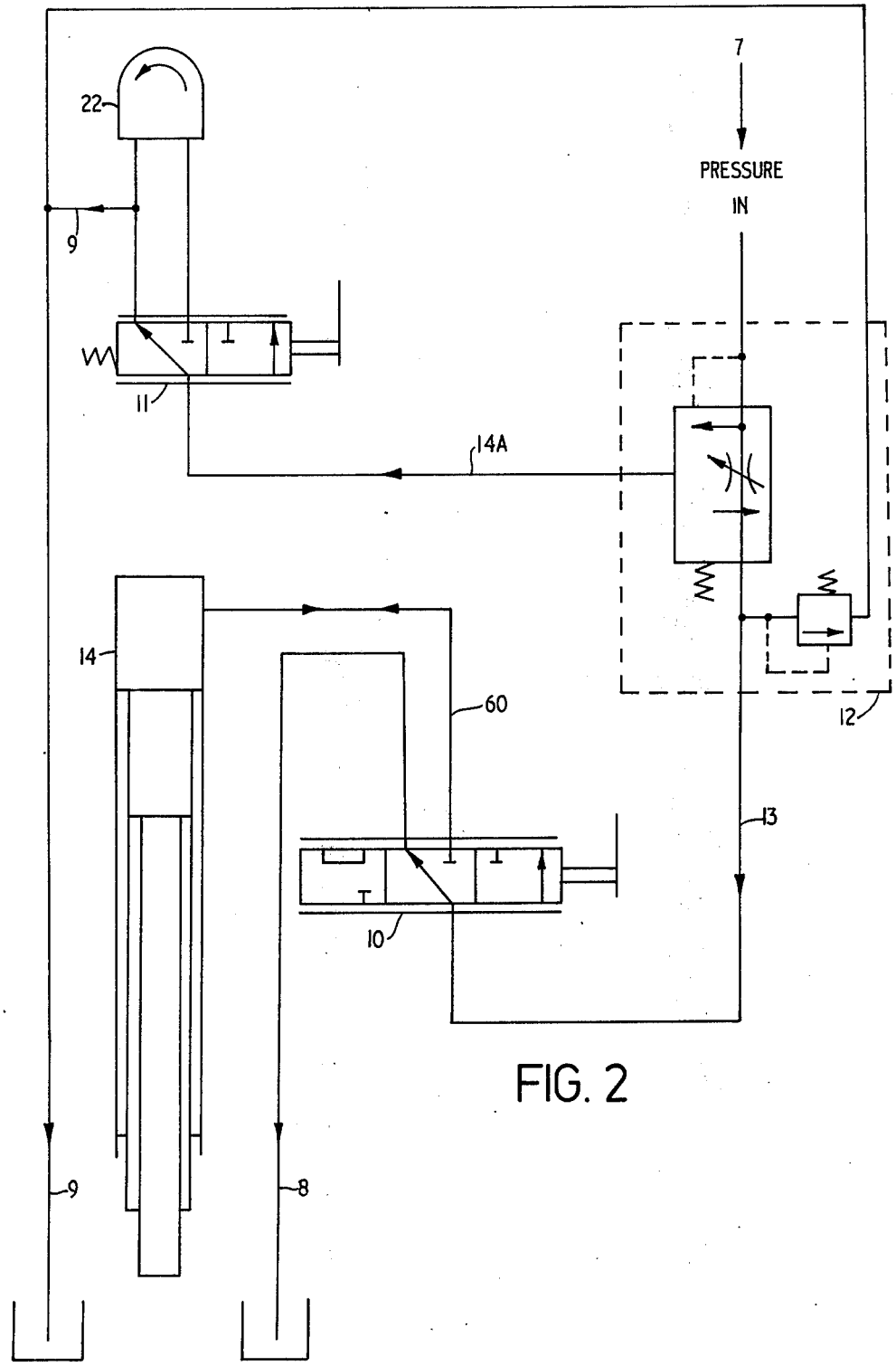
FIG. 2 is a diagrammatic view of the hydraulic circuit.

FIG. 2 shows the hydraulic circuit in schematic form. It will be seen that oil under pressure passes into the priority flow control valve 12 and is divided into two separate circuits, one of which is a priority circuit which is set to a gallonage suitable to the desired speed at which the components of the cylinder 14 are to displace. This priority circuit has an integral pressure relief valve set to relieve at a predetermined thrust resistance. Manual control of this circuit is effected by the control valve 10 which is depicted in the position where the cylinder 14 is locked at a set extension.

The second circuit consists of the remainder of the oil supplied to valve 12 which is delivered to the hydraulic motor 22 through the control valve 11 depicted in the OFF position.

Hose 9 represents the power source return line and hose 8 represents the non restricted oil line returning directly into the power source reservoir.

Figure 3:
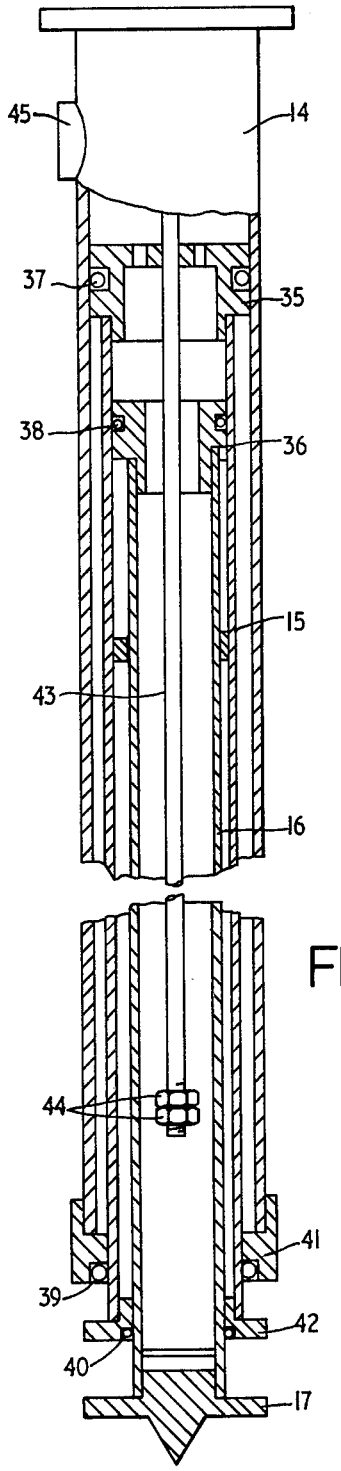
FIG. 3 is a sectional view of the hydraulic thrust cylinder which provides telescopic extension of the unit.

We refer next to FIG. 3. The cylinder body 14, while providing mountings for the motor shell 34 (FIG. 1) also provides the bore for the travel cylinder flange 35 secured to the travel cylinder 15. The travel cylinder 15 in turn provides the bore for the support leg flange 36 secured to the support leg 16. Seals 37 and 38 retain the oil within the leg and seals 39 and 40 exclude dust.

Sleeves 41 and 42 provide lateral support for the lower ends of the leg components and the end pad 17 is a floor pad to support the unit. A stop shaft 43 — acts as a stop for the travel cylinder 15 which in turn acts as a stop for the support leg 16. Limit stop nuts 44 are secured to the end of the stop shaft 43. Flange 45 provides a threaded entrance port for the oil hose 60 (FIG. 1).

Figure 4:
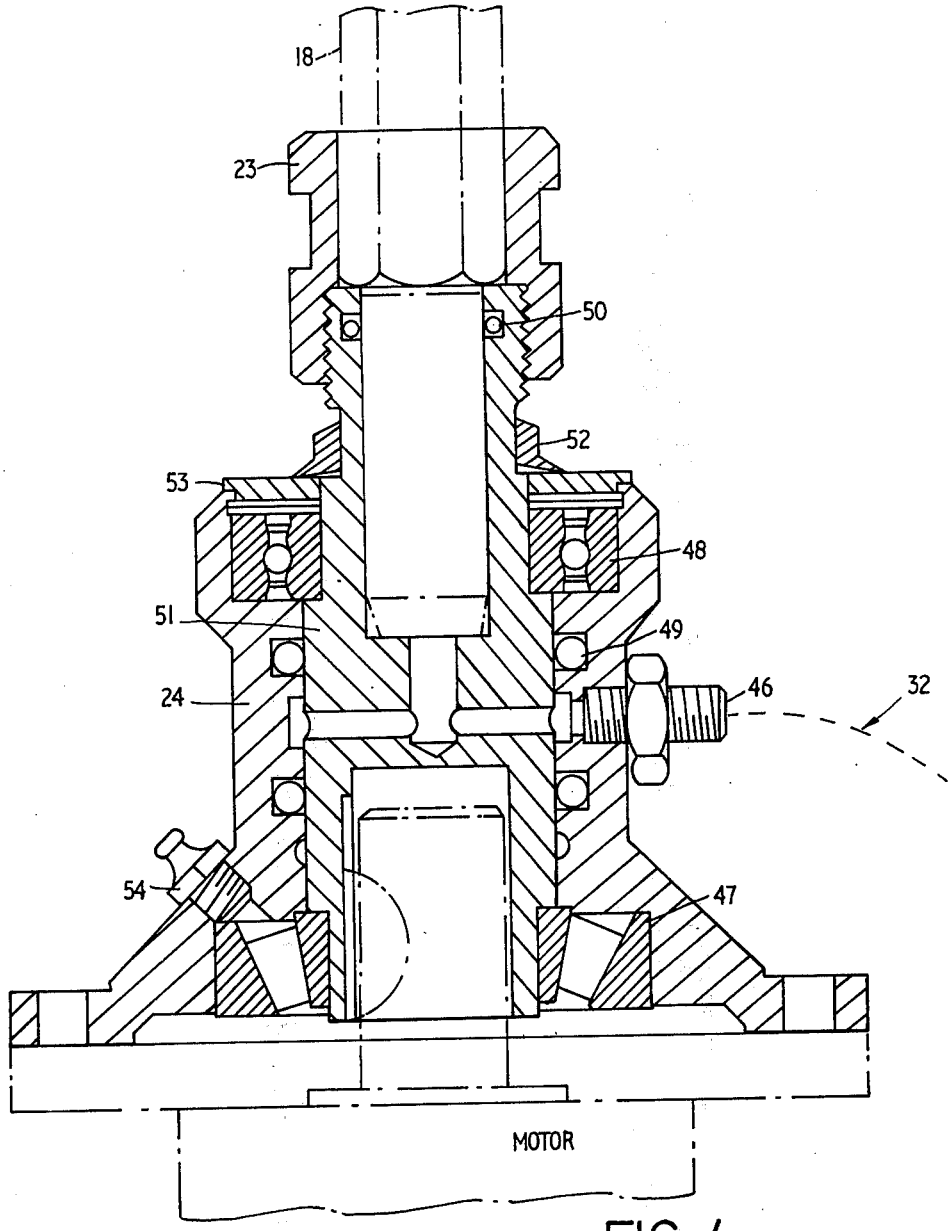
FIG. 4 is a sectional view of the wet drilling unit.

FIG. 4 is a sectional view of the wet drilling unit 24 (FIG. 1). Water for dust suppression and swarf removal is piped to the inlet connection 46 and passes through internal passages to the end of the drill rod 18. The drill unit housing 24 contains bearings 47 and 48 to resist axial thrust and lateral forces respectively. 'O' rings 49 seal the water passages from the bearings and O ring 50 prevents water escaping through the cavity between the drill rod 18 and the spindle 51. The drill collar or chuck 23 is screwed onto spindle 51 and has internal flats to transmit torsional efforts to the hexagonal drill rod 18. A V-ring seal 52 and dust seal plate 53 exclude dust from entering the bearing 48 cavity and a lubrication nipple 54 is provided for the tapered roller race 47.

Figure 5:
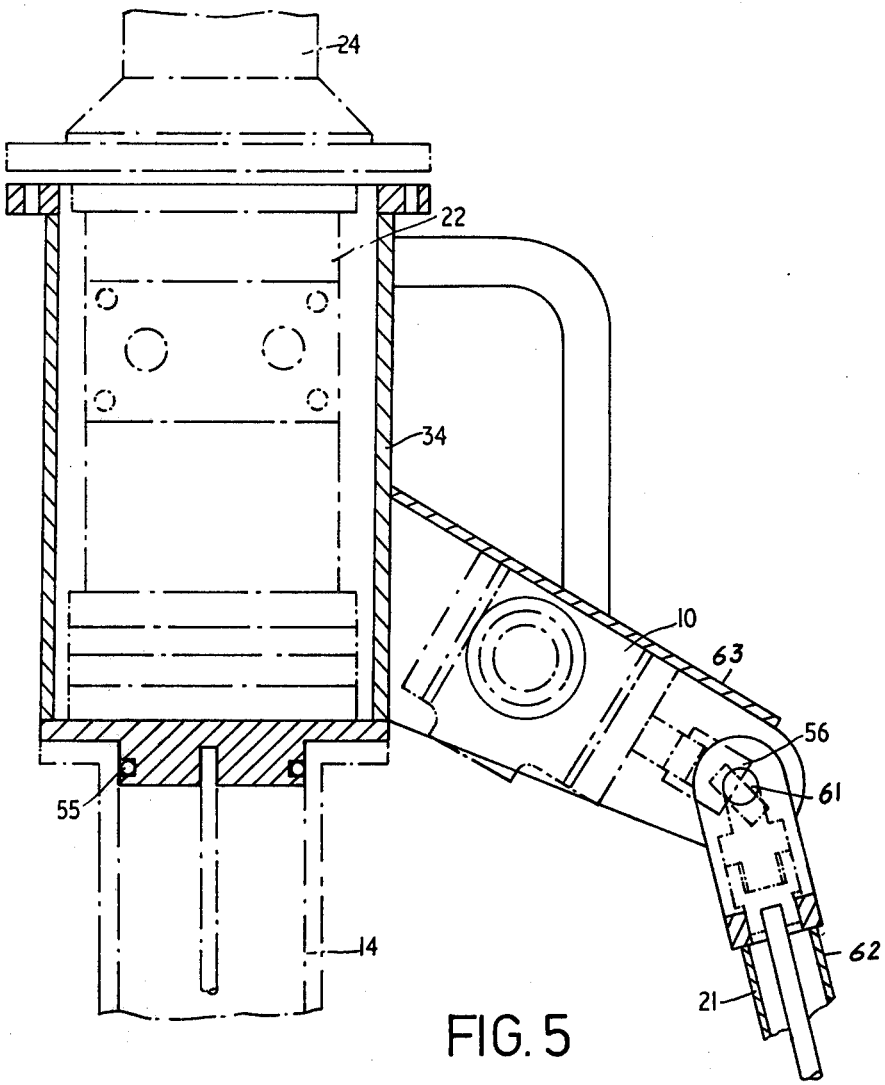
FIG. 5 is a sectional view of the motor shell.

FIG. 5 shows the hydraulic rotation motor 22 mounted within the motor shell 34 thus isolating the motor from the end thrust produced by the leg cylinder 14. The shell 34 is mounted on the leg cylinder 14 incorporating seal 55 and also provides mountings for the wet drilling unit 24. The cowing on the side of the shell 34 provides a protected housing for mounting valve 10. The universal joint 56 transmitting the torsional effort to operate valve 10 and its relative connections to valve 10 and to the pivoted control arm 21 is shown.

The upper end 62 of the control arm 21 is pivotally connected to a support bracket 63 secured to the motor shell 34. The pivot 61 or the pivotal axis of any other suitable form of alternative pivot means is aligned to provide pivotal movement of the control arm 21 in a plane passing through or parallel to the axis of rotation of the drill rod 28 and motor 22.

Figure 6:
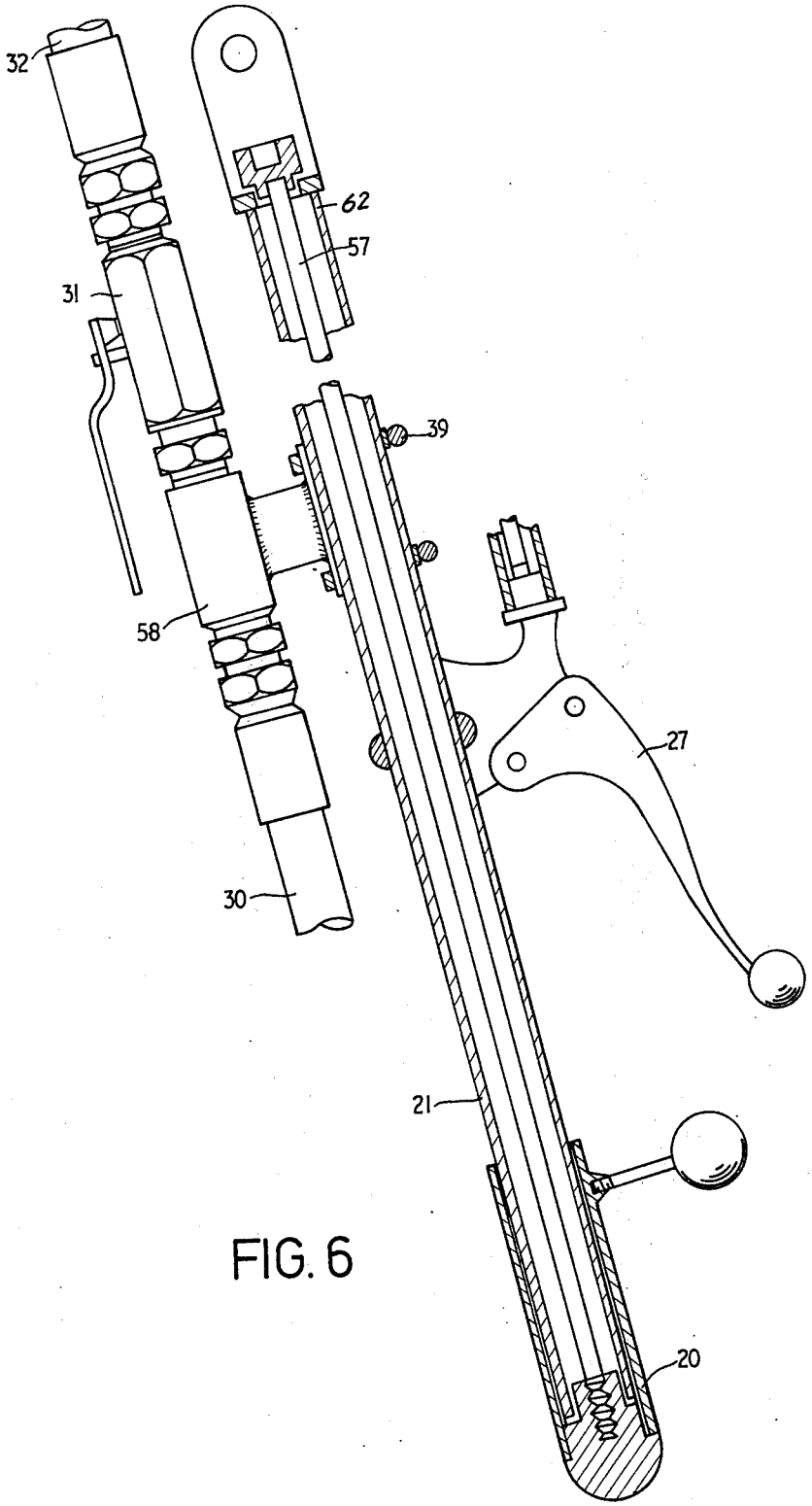
FIG. 6 is a sectional view of the control handle.

FIG. 6 is a part sectional view of the pivoted control arm 21 which provides a means of resisting the torque transmitted by the unit to the pit roof. The arm also provides support for the control handle 27 which activates motor valve 11 (FIG. 1) and the twise grip 20 which controls legs valve 10 (FIG. 1) through the control rod 57 and universal joint 56, (FIG. 5).

The ON/OFF water cock 31, its bracket 58 and connected hoses 30 and 32 are fastened to the control arm 21 with clips 59.

Various lengths of drill rods may be used to produce the desired depth of hole.

The roof drilling machine according to the invention is compact, allowing it to be stowed easily without restricting emergency exits on either side of the coal winning machinery.

It is a unit that can be operated by one person in a position not directly beneath the hole being drilled, thus keeping the operator clear of the swarf and parts of broken roof which may be dislodged during the operation. Further the control arm 21 in its extended position enables the operator to reset the reaction torque of the drill motor during the drilling operation.

Control of the rotation of the drill rod is by means of a "dead man's grip" so as to provide safety for the operator and nearby personnel.

What I claim is:

1. Drilling equipment for drilling holes in mine roofs for the purpose of rock bolting comprising an intermediate portion having mounted on and extending from it at one end a telescopic leg and mounted on and extending from it at the other end a drill rod; a rotary hydraulic motor mounted on said intermediate portion and coupled to the drill rod, first valve means connected to a pressure fluid source for supplying pressure fluid to the leg for extending it or for releasing fluid from the leg; second valve means connected to a pressure fluid source for supplying pressure fluid to the hydraulic motor for driving it or for shutting-off the supply of pressure fluid to the motor for stopping it, said first and second valve means being mounted on said intermediate portion; an elongated torque and control arm connected at one end about a pivot to said intermediate portion, the axis of the pivot being aligned transverse to the axis of the drill rod, the torque and control arm having at its outer end manual first and second actuator means, the torque and control arm permitting an operator to resist the torque produced by the drill when in operation, and transmission means coupled between said first and second actuator means and the first and second valve means respectively, thereby allowing the operator to control from a distance the first and second valve means of the drill independently of each other.

2. Equipment as in claim 1 wherein said intermediate portion comprises a drilling unit and a shell, the drilling unit being connected at one end of the shell, a spindle rotatably mounted in the drilling unit, means substantially preventing endwise displacement of the spindle in the drilling unit, said spindle being coupled at one end to one end of said drill rod, said shell being connected at its other end to the adjacent end of the telescopic leg, said motor being mounted in the shell with the motor shaft extending from said shell into the drilling unit and being coupled to the other end of said spindle.

3. Equipment as in claim 1 wherein said actuator means for controlling said first and second valve means comprises two displaceable control elements coupled respectively by said transmission means to said two valve means for operating said valves so as to control the flow of pressure fluid through the valves.

4. Equipment as in claim 1 wherein said first valve means in one operating position receives pressure fluid from the source and feeds it to the telescopic leg, said first valve means in another operating position receiving pressure fluid from the telescopic leg and returning it to the source.

5. Equipment as in claim 1 wherein said second valve means in one operating position receives pressure fluid from the source and feeds it to said motor, said second valve means in another operating position diverting pressure fluid from said motor and returning it to the source.

6. Equipment as in claim 4 wherein said second valve means in one operating position receives pressure fluid from the source and feeds it to said motor, said second valve means in another operating position diverting pressure fluid from said motor and returning it to the source.

7. Equipment as in claim 1 wherein one of said actuator means is a rotary actuator and the other of said actuator means is a linear actuator.

8. Equipment as in claim 7 wherein one of said transmission means is coupled to said rotary actuator and comprises rotary transmission means, and the other of said transmission means is coupled to said linear actuator and comprises linear transmission means.

9. Drilling equipment for drilling holes in mine roofs for the purpose of rock bolting, said equipment comprising an intermediate portion, an extendible leg mounted on and extending from one end of said intermediate portion, drill rod holding means mounted on and extending from another end of said intermediate portion, said another end of said intermediate portion being remote from said one end thereof, a rotary hydraulic motor mounted on said intermediate portion and coupled to said drill rod holding means, a longitudinal axis of said leg being substantially coaxial with the axis of rotation of said drill rod holding means, valve means for supplying pressure fluid to said motor and said leg, said valve means being mounted on said intermediate portion, an elongated torque and control arm pivotally connected at one end thereof to said intermediate portion for pivotal movement in the plane of the axis of rotation of said drill rod holding means, manual actuator means at another end of said torque and control arm remote from said one end thereof, and transmission means coupled between said actuator means and said valve means, thereby allowing an operator to control said drilling equipment from a distance.

* * * * *